US007437878B2

(12) United States Patent
Gedeon et al.

(10) Patent No.: US 7,437,878 B2
(45) Date of Patent: Oct. 21, 2008

(54) MULTI-STAGE PULSE TUBE CRYOCOOLER WITH ACOUSTIC IMPEDANCE CONSTRUCTED TO REDUCE TRANSIENT COOL DOWN TIME AND THERMAL LOSS

(75) Inventors: David R. Gedeon, Athens, OH (US); Kyle B. Wilson, Logan, OH (US)

(73) Assignee: Sunpower, Inc., Athens, OH (US)

( * ) Notice: Subject to any disclaimer, the term of this patent is extended or adjusted under 35 U.S.C. 154(b) by 69 days.

(21) Appl. No.: 11/209,983

(22) Filed: Aug. 23, 2005

(65) Prior Publication Data

US 2008/0229760 A1 Sep. 25, 2008

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS

| | | | | |
|---|---|---|---|---|
| 5,487,272 | A * | 1/1996 | Nagao | 62/6 |
| 6,330,800 | B1 * | 12/2001 | Price et al. | 62/6 |
| 2002/0112484 | A1 * | 8/2002 | Kim et al. | 62/6 |
| 2004/0000149 | A1 | 1/2004 | Kirkconnell et al. | |
| 2004/0112065 | A1 | 6/2004 | Pan et al. | |
| 2004/0187519 | A1 * | 9/2004 | Zhu et al. | 62/613 |

* cited by examiner

*Primary Examiner*—William C Doerrler
(74) *Attorney, Agent, or Firm*—Frank H. Foster; Kremblas, Foster, Phillips & Pollick

(57) ABSTRACT

The cool down time for a multi-stage, pulse tube cryocooler is reduced by configuring at least a portion of the acoustic impedance of a selected stage, higher than the first stage, so that it surrounds the cold head of the selected stage. The surrounding acoustic impedance of the selected stage is mounted in thermally conductive connection to the warm region of the selected stage for cooling the acoustic impedance and is fabricated of a high thermal diffusivity, low thermal radiation emissivity material, preferably aluminum.

19 Claims, 3 Drawing Sheets

MULTI-STAGE PULSE TUBE CRYOCOOLER WITH ACOUSTIC IMPEDANCE CONSTRUCTED TO REDUCE TRANSIENT COOL DOWN TIME AND THERMAL LOSS

STATEMENT REGARDING FEDERALLY-SPONSORED RESEARCH AND DEVELOPMENT

This invention was made with Government support under contract NAS5-02021 awarded by NASA. The Government has certain rights in this invention.

CROSS-REFERENCES TO RELATED APPLICATIONS (Not Applicable)

REFERENCE TO AN APPENDIX (Not Applicable)

BACKGROUND OF THE INVENTION

1. Field of the Invention

This invention relates generally to pulse tube cryocoolers and more particularly to the construction of the acoustic impedance associated with the second or later stage of a multi-stage pulse tube cryocooler to reduce the transient time interval required to cool the cryocooler down to its operating temperature.

2. Description of the Related Art

Pulse tube coolers have been recognized as having desirable characteristics for cooling to cryogenic temperatures. They typically comprise a pressure wave generator, such as a reciprocating diaphragm or piston, connected through a regenerator to one end of a pulse tube. The opposite end of the pulse tube is connected to an acoustic impedance in order to properly phase the internal working gas pressure and velocity. Heat is accepted at a cold region, ordinarily at the regenerator end connected to the pulse tube, and rejected at a warm region, ordinarily at the opposite end of the regenerator. The working fluid within the pulse tube cooler pumps heat from the cold region to the warm region as it undergoes spatially displaced expansions and compressions produced by properly phased pressure and displacement fluctuations. Heat exchangers, such as a copper housing containing copper screens conductively connected to the housing, are located in the warm and cold regions for transporting heat between the working gas and attached conductive masses.

One configuration used for pulse tube cryocoolers is the U-tube configuration such as illustrated in U.S. patent publication number 2004/0000149. The pulse tube and regenerator are approximately parallel and form the legs of the U. They are joined by a turning manifold at which heat is accepted and a heat exchanger is constructed in or adjacent the turning manifold. With this configuration, the warmer regions of the regenerator and the pulse tube are located in relatively close proximity nearer one end of this configuration and the cold regions are located at the opposite end of the configuration. The assembled pulse tube, regenerator and turning manifold, along with their heat exchangers, are commonly referred to as a cold head.

Pulse tube coolers can be cascaded in multiple stages in order to provide colder temperatures and improve efficiency. A two stage cryocooler, having each stage in a U-tube configuration, is illustrated in the above cited patent publication but there may be three or more stages. In staging, the cold, heat accepting region of a stage is thermally connected to the warm, heat rejecting region of a subsequent stage. Each stage pumps heat from its cold region to its warm region, the heat is conducted to the cold region of the previous stage and this continues along the cascaded stages until the heat is rejected from the warm region of the first stage into the ambient environment or some cooling medium.

In addition to the cold head, the pulse tube cooler also requires an acoustic impedance in order to properly phase the pressure and velocity of the working gas within the pulse tube cryocooler so that heat will be pumped through the regenerator. An acoustic impedance is a structure that exhibits phase characteristics that are analogous to electrical impedances. A relatively large volume receptacle, called a reservoir, surge volume or buffer, exhibits principally a characteristic known as compliance. A compliance is analogous to a capacitor connected to ground because the volume flow rate or velocity leads the pressure by 90° as a result of the compressibility of the gas. A relatively long, narrow tube exhibits principally a characteristic called inertance. An inertance is analogous to an inductor because the volume flow rate or velocity lags the pressure by 90° as a result of the momentum of the gas. Consequently a compliance introduces a phase lead and an inertance introduces a phase lag. The terms "lags" and "leads" are relative terms that depend upon the sign convention used for velocity; that is whether + is in or out of the volume under consideration. Therefore, other descriptions may interchange these terms when the + and − sign convention is interchanged. An orifice is analogous to a resistance because, at an orifice, the velocity and pressure are in phase.

Using these impedance characteristics, proper phasing is commonly designed into a pulse tube cryocooler by selection of one or more acoustic impedances to provide the desired phase relationships. Acoustic impedance, as used in pulse tube devices and other thermoacoustic systems, is discussed in more detail in *Thermoacoustics*, by G. W. Swift, published by the Acoustical Society of America (2002). Commonly, the acoustic impedance is an inertance assembly that is a long, relatively narrow tube, or two series-connected tubes of differing diameter, connected at one end to the pulse tube and at its other end to a compliance in the form of a reservoir.

The cold heads for each stage and the acoustic impedance for at least the stages after the first stage, are typically enclosed in a vacuum vessel. The vessel is maintained under high vacuum in order to prevent or minimize parasitic conduction and convection of heat from the ambient environment to the pulse tube cooler components.

When the operation of a cryocooler of the type described is initiated, the components must be cooled down under transient conditions to the normal operating temperatures for which they were designed. Because these components have a substantial mass, they can store a substantial quantity of heat and therefore the cool down time is substantial. This cool down time can be measured in hours and may, for example, require a half hour. After the components reach a steady state, they must be maintained at their operating temperatures. The components are cooled to, and maintained at, their operating temperatures by conduction of heat through the components to the cold region of a stage and the pumping of the heat through the pulse tube cooler or multiple staged coolers. However, despite the vacuum for preventing conduction and convection load, the pulse tube components have a thermal radiation load as a result of heat being transferred by radiation from the interior wall of the surrounding vacuum vessel. The surrounding vessel may, for example, be at an ambient temperature on the order of 300 K while the temperatures of the components within the pressure vessel may range in stages down to a temperature on the order of 20 K or 30 K, for example.

The prior art has sought to solve the thermal radiation load problem by wrapping the cold heads with radiation shields within the vacuum vessel to prevent direct radiation from the interior wall of the vacuum vessel to the cold heads. These radiation shields are commonly layers of highly reflective material that are wrapped around the cold head for the purpose of reflecting incoming thermal radiation. The typical wrapping is a blanket of multi-layer foil insulation (commonly known as MLI) directly on and around the cold head. This blanket is made of alternate layers of aluminized Mylar film separated by thin layers of fibrous insulation spacer layers. Their temperature varies through a gradient from the cold region temperature to the warm region temperature of the cold head.

However, the use MLI creates problems. The MLI requires careful cutting and hand wrapping, requires difficult manipulative operations to deal with wire feed throughs and other penetrations, and it requires a large amount of time to outgas all water vapor and other contaminants from the foil layers (several days or more pumping time).

It is an object and feature of the invention to reduce the transient cool down time for multi-stage, pulse tube cryocoolers, to improve the efficiency of maintaining the cooled operating temperatures and to avoid the difficulties associated with wrapping cold heads with multi-layer insulation.

BRIEF SUMMARY OF THE INVENTION

At least a portion of the acoustic impedance of a selected stage after (numbered higher than) the first stage, is spaced outwardly from and surrounds the cold head of the selected stage and is mounted in thermally conductive connection to the warm region of the selected stage for cooling the acoustic impedance to or near the temperature of that warm region. The acoustic impedance component that surrounds the cold head of the second or higher stage is constructed of a metal having a high thermal diffusivity and low thermal radiation emissivity, preferably aluminum. As a result, the surrounding acoustic impedance component not only acts as a radiation shield and eliminates the need for a separate shield, but it also permits heat to be conducted out of the impedance component at an increased rate.

Figure 1:
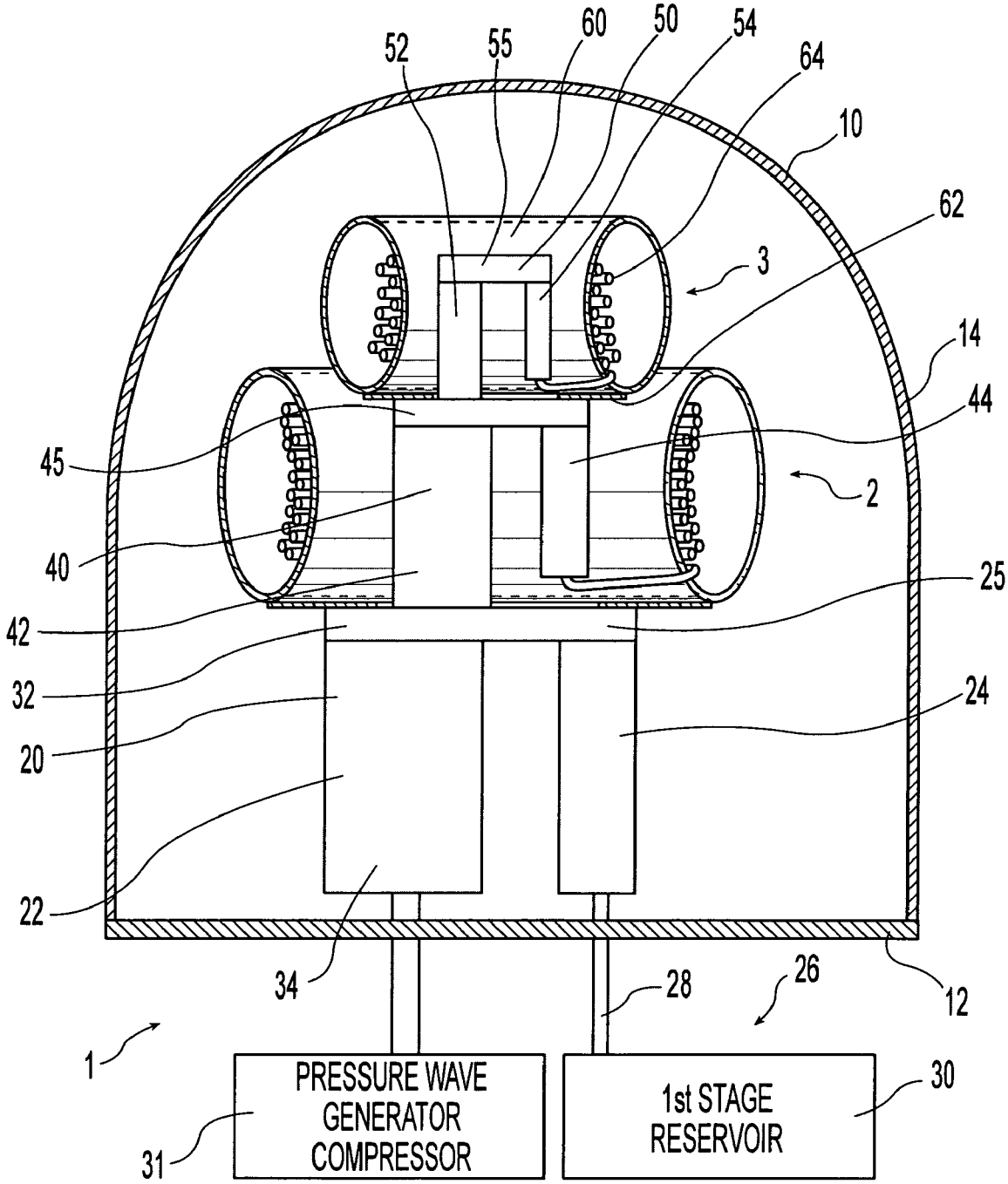
FIG. 1 is a simplified, schematic diagram illustrating the principles and concepts of the invention and showing the acoustic impedance components in vertical section.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or terms similar thereto is used. They are not limited to direct connection, but include connection through other structures where such connection is recognized as being equivalent by those skilled in the art.

DETAILED DESCRIPTION OF THE INVENTION

FIG. 1 illustrates, diagrammatically and symbolically, a pulse tube cryocooler that consists of three, cascaded, pulse tube cooler stages 1, 2 and 3. Most components of these stages are contained in a vacuum vessel 10 formed by a bottom support plate 12 and a bell-shaped closure 14 sealed to the support plate 12.

The first stage pulse tube cooler 1 includes a cold head 20 that has a regenerator 22 connected to one end of a pulse tube 24 through a turning manifold 25. It also has an acoustic impedance 26 connected to the cold head 20 at the opposite end of the pulse tube 24 in order to properly phase the internal gas pressure and velocity in the first stage. The term "connected" means that the interior spaces within these components are connected in fluid communication. The first stage acoustic impedance 26 consists of an inertance tube 28 connected to a reservoir 30. A pressure wave generator 31 is connected to the warm end of the first stage regenerator 20 and can be a conventional or other compressor having the characteristics known to those skilled in the art. It propagates a single acoustic wave through all stages. In the preferred embodiment, the pressure wave generator 31 is a dual-opposed, free-piston, oscillating compressor operating at 30 Hz.

Each pulse tube cooler has a heat accepting cold region and a heat rejecting warm region that operate at two different temperatures. The terms "cold" and "warm" are relative terms that refer to the relative temperatures of the same stage and signify that the "cold" region of a stage is at a lower temperature than the "warm" region of the same stage. Consequently, the first stage pulse tube cooler 1 has a cold region 32 at the turning manifold 25 for accepting heat and a warm region 34 for rejecting heat. Because the operating temperature of the acoustic impedance of each stage is the temperature of the warm, heat rejecting region of the stage, the inertance 28 and reservoir 30 for the first stage can be located outside the vacuum vessel 10 in the ambient atmosphere. This first stage is a typical, prior art, pulse tube cooler in a U-tube configuration.

The pulse tube coolers are staged by thermally connecting the cold region of a lower stage to the warm region of a higher stage. Consequently, those thermally connected regions are at the same temperature and heat is transferred through them from the higher stage to the lower stage. In FIG. 1, the cold heads of the higher, subsequent stages are illustrated as objects that are shaped identically to the cold head 20 of the first stage. Thus, the second stage pulse tube cooler 2 includes a cold head 40 that has a regenerator 42 connected to one end of a pulse tube 44 through a turning manifold 45. The third stage pulse tube cooler 3 includes a cold head 50 that has a regenerator 52 connected to one end of a pulse tube 54 through a turning manifold 55. Each stage is connected to its adjacent stage in fluid communication as known to persons skilled in the art.

However, the acoustic impedance components of the second and third stages are different from the conventional acoustic impedance components of the first stage. At least a portion of the acoustic impedance of a selected stage, higher than the first stage, is spaced outwardly from and surrounds the cold head of the selected stage. The surrounding component of the acoustic impedance of the selected stage is mounted in thermally conductive connection to the warm region of the selected stage for cooling the acoustic impedance. This not only is a convenient place to physically support the acoustic impedance, but more importantly the acoustic impedance should be at the same temperature as the warm, heat rejecting region of its pulse tube cooler stage in order to attain the desired working gas phasing based upon the temperature dependent properties of the working gas.

The acoustic impedances of the second and third stages illustrated in FIG. 1 have the identical configuration and therefore only the third stage acoustic impedance is described. The reservoir 60 of the third stage is a hollow, sealed toroid surrounding the cold head 50 of the third stage 3. It has an oval cross section although other cross sections can be used. This annular reservoir 60 is thermally and mechanically attached to a metallic, annular disk 62, such as by welding or brazing, to provide a thermally conductive support or mounting plate. Alternatively, these structures, like many others, can be integrally formed or machined from the same piece of material to combine their functions. The disk 62 is thermally and mechanically attached to the turning manifold 45 of the second stage, such as by screws, bolts or other fasteners, so that the disk 62 and the reservoir 60 are physically supported on the turning manifold 45 and heat can be conducted from the reservoir 60 to the turning manifold 45.

In order to conserve space, provide mechanical support and maximize heat conduction to cool the acoustic impedance, the inertance tube 64 is advantageously wound as a coil within the reservoir 60. One end of the inertance tube 64 extends through the wall of the reservoir 60, and is sealed to it, and continues into connection at an end of the pulse tube 54. Since an inertance tube is typically several meters in length, there will normally be more turns than illustrated diagrammatically in FIG. 1. Manufacturing can be facilitated by forming the reservoir of two parts separated along a plane that is perpendicular to the axis of the reservoir. The inertance tube 64 can be coiled and inserted within one part of the reservoir and the two parts are then welded or otherwise attached and sealed together. Alternatively, the inertance tube can be coiled radially inwardly or outward of the annular reservoir 60.

One aspect of the effectiveness of the invention can be seen by considering the thermal radiation within the vacuum vessel. The vacuum vessel wall is typically at room temperature, for example 300 K, and, like any body, radiates heat inwardly as an increasing function of its temperature, and specifically as the $4^{th}$ power of its absolute temperature. The net heat transfer between two interfacing bodies is an increasing function of the temperature differential between them. The interposed acoustic impedance component that surrounds the cold head of its selected stage is maintained at a considerably lower temperature than the vacuum vessel 14. That acoustic impedance is maintained at the temperature of the selected stage's warm region, for example 80 K, because that acoustic impedance is connected to the warm region of its stage by a thermally conductive support structure. Therefore, because the acoustic impedance is shaped to surround the cold head, it can replace a conventional radiation shield and thus eliminate the need for a separate radiation shield. Because the acoustic impedance is connected in thermally conductive connection to the warm region of the selected stage (the cold region of the preceding stage) and actively cooled to the temperature of the preceding stage, it interrupts the incoming radiation at a higher temperature than the cold head and allows the inwardly radiated heat to be pumped out of the system from a higher temperature. This is important because, with all cryocoolers, the lower the temperature from which heat must be pumped, the greater the power consumed to pump it up to ambient temperature. Measured in electrical power input requirements, it takes roughly 15 times more power input to lift 1 W heat at 20 K compared to 1 W at 80 K. Having a radiation shield anchored at around 80 K to the first stage means that almost the entire radiation heat load is intercepted at a temperature where it is relatively easy to remove it. With this strategy it is possible to greatly reduce the radiation heat load on the second stage without the need for any MLI. The same principle applies to the third stage radiation heat load.

Because the acoustic impedance components are needed regardless of how they are constructed and they are already being maintained at their lower temperatures for operating efficiency reasons, configuring and positioning the acoustic impedance to surround the cold head adds a second or dual purpose. In other words, because the acoustic impedance is already being cooled to a reduced temperature, configuring it to surround the cold head reduces the temperature differential between the cold head and the surface that radiates onto the cold head and therefore reduces the heat transfer by radiation to the cold head.

The invention therefore integrates the radiation shield function into the portion of the acoustic impedance that surrounds the cold head. It eliminates the need for the more expensive, hand applied MLI radiation shield and instead integrates that function into the hardware. Of course both the invention and MLI can be combined and used together in the same cryocooler if desired.

If the inertance tube 62 is alternatively positioned interiorly of the annular reservoir 60, it is principally the inertance tube component that will radiate onto the cold head 50 from this cooler temperature. As still another alternative, only the inertance tube component of the acoustic impedance can be coiled around the cold head and the reservoir can be a conventional vessel that does not surround the cold head. In that case the coil of inertance tube functions with respect to heat radiation to effect the advantages of the invention.

The meaning of the term "surround" in the context of the invention deserves some explanation. Obviously it is impossible for any component of the acoustic impedance to surround a cold head in the sense that an egg shell surrounds an egg or that a closed box surrounds its contents. The acoustic impedance can not entirely surround the cold head so that a line extending in each and every direction from the cold head would intersect the acoustic impedance. The invention contemplates "surrounding" in the sense that a ring surrounds a line. It is spaced outwardly, laterally or radially from the cold head. Additionally, "surrounding" ordinarily implies continuity through the entire 360° arc around a surrounded object. However, although it is preferred that there not be gaps in the continuity of the surrounding acoustic impedance component, relatively short gaps could be tolerated. They would only deteriorate the effectiveness of the invention in proportion to the size of the gap.

Furthermore, the axial length or dimension of the surrounding acoustic impedance is not critical. An understanding of the operation of the invention reveals that the longer the axial length of the surrounding acoustic impedance, the more effectively it can function to reduce radiation although thermal conduction through it would be impeded. The axial length of the surrounding acoustic impedance is preferably at least coextensive with the cold head and most preferably is longer than the length of the cold head but not so long that it interferes with other stages. This prevents radiation from the vacuum vessel over the widest arc or range of angles of incidence. However, the axial length can be shorter than the length of the cold head and still be effective. In particular, it is most important that the acoustic impedance surround the cold head by being positioned outwardly from at least the cold region of the cold head, the turning manifold in the illustrated embodiments, because that is the coldest part of each stage and therefore is the part at which thermal radiation load is most critical.

The shape of a reservoir that surrounds the cold head is also not critical. It is not necessary that it be symmetrical or that it be mounted symmetrically around the cold head, although both characteristics are preferred. Although a generally circular configuration is preferred, the reservoir can be square, rectangular, octagonal or other shapes. The cross sectional configuration can also vary considerably from that illustrated.

The cool down time is further substantially reduced by forming the surrounding acoustic impedance of a metal that has a high diffusivity and low emissivity. Although the reservoir of a pulse tube cooler typically found in the prior art is constructed of stainless steel, forming it of aluminum greatly improves the advantageous results of the invention for the following reasons.

Thermal diffusivity is a characteristic of materials that is a measure of the rate of propagation of heat through a material. If a material is heated or cooled at one location, a thermal temperature gradient wave will propagate through the material until other locations reach a steady state at an increased or reduced temperature. Because the components of a pulse tube cooler, including the acoustic impedance, have a substantial thermal mass, it takes time to cool it down to its steady state operating temperature for two reasons: (1) the quantity of mass that needs to be cooled down; and (2) the length of the path of conduction from the source of cooling to some parts and along which heat must be conducted to cool the parts. This means that a stainless body will take much longer to heat up or cool down than a similarly configured aluminum body because the thermal diffusivity of aluminum is much greater.

Another factor that retards the transient cooling down process of the pulse tube cooler to its operating temperature is the radiation of heat from its vacuum vessel as previously described. Emissivity is a characteristic of materials that is a measure of the rate of radiation of heat to and from the material. The higher the emissivity of a material, the more nearly it radiates at the rate of a black body. Since embodiments of the invention have the acoustic impedance of a second or later stage surrounding the cold head of that stage and therefore radiating heat to the cold head, the surrounding acoustic impedance should exhibit the lowest practical thermal emissivity.

We have found that aluminum has an optimum and preferred combination of relatively high thermal diffusivity and relatively low emissivity giving it substantial advantages over other materials. Of course the selection of any material for any function requires engineering tradeoffs and compromises in order to obtain maximum effectiveness. Mechanical strength is another important characteristic required for materials used in constructing components of pulse tube coolers. However, aluminum and alloys of aluminum exhibit a combination of all these characteristics that cause aluminum to provide superior results.

The following tables of Diffusivity and Emissivity for selected metals illustrate the heat transfer advantages of using aluminum:

TABLE 1

| Metal | Thermal Diffusivity [$m^2/s$] |
|---|---|
| Stainless Steel 304 | 4.045E-06 |
| 6061-T6 Aluminum | 6.890E-05 |
| Copper | 1.136E-04 |
| Brass | 3.633E-05 |

TABLE 2

| Metal | Temperature [K] | Emissivity |
|---|---|---|
| Aluminum, polished (2024-T6) 33 μin roughness | 4.2 | 0.018 |
| Aluminum, polished (2024-T6) 33 μin roughness | 20 | 0.018 |
| Aluminum, polished (2024-T6) 33 μin roughness | 77 | 0.023 |
| Aluminum, polished (2024-T6) 33 μin roughness | 300 | 0.050 |
| Copper, polished (41 μin roughness) | 4.2 | 0.054 |
| Copper, polished (41 μin roughness) | 20 | 0.055 |
| Copper, polished (41 μin roughness) | 77 | 0.070 |
| Copper, polished (41 μin roughness) | 300 | 0.100 |
| 304 Stainless steel, polished 27 μin roughness | 4.2 | 0.078 |
| 304 Stainless steel, polished 27 μin roughness | 20 | 0.087 |
| 304 Stainless steel, polished 27 μin roughness | 77 | 0.13 |
| 304 Stainless steel, polished 27 μin roughness | 300 | 0.17 |
| Aluminum, mechanical polish | 4.2 | 0.058 |
| Aluminum, mechanical polish | 77 | 0.10 |
| Aluminum, oxide layer | 4.2 | 0.074 |
| Aluminum, oxide layer | 77 | 0.49 |
| Copper, as received | 4.2 | 0.062 |
| Copper, as received | 77 | 0.12 |
| 304 Stainless steel, mechanical polish | 4.2 | 0.074 |
| 304 Stainless steel, mechanical polish | 77 | 0.12 |
| 304 Stainless steel, mechanical polish | 300 | 0.16 |
| 304 Stainless steel, as received | 4.2 | 0.12 |
| 304 Stainless steel, as received | 77 | 0.34 |

Preferably, the metal used to embody the invention has a thermal diffusivity of at least 20E-06 $m^2/s$ and most preferably at least 50E-06 $m^2/s$. Preferably that metal has an emissivity not exceeding 0.060. Most preferably the metal is within both the above limits.

As known in the art, thermal emissivity is also dependent upon the surface morphology of a material. A smoother surface radiates less than a rougher surface. Therefore it is also desirable to use a polished surface with embodiments of the invention.

As an example of the improvement in the cool down time for a second stage to cool down to the first-stage temperature when the high diffusivity metal is used, this time may be roughly approximated as:

$$t \approx \frac{L^2}{\alpha}$$

where $\alpha$ is the thermal diffusivity of the metal and L is the length of the conduction path. A typical conduction path length for the preferred embodiment is on the order of 0.1 m long. For stainless steel with a thermal diffusivity of about 5E-6 $m^2/s$, the diffusion time according to the above equation is approximately 2000 seconds (33 min). On the other hand, with aluminum the thermal diffusivity is about 14 times higher so the diffusion time is only about 150 seconds.

Figure 2:
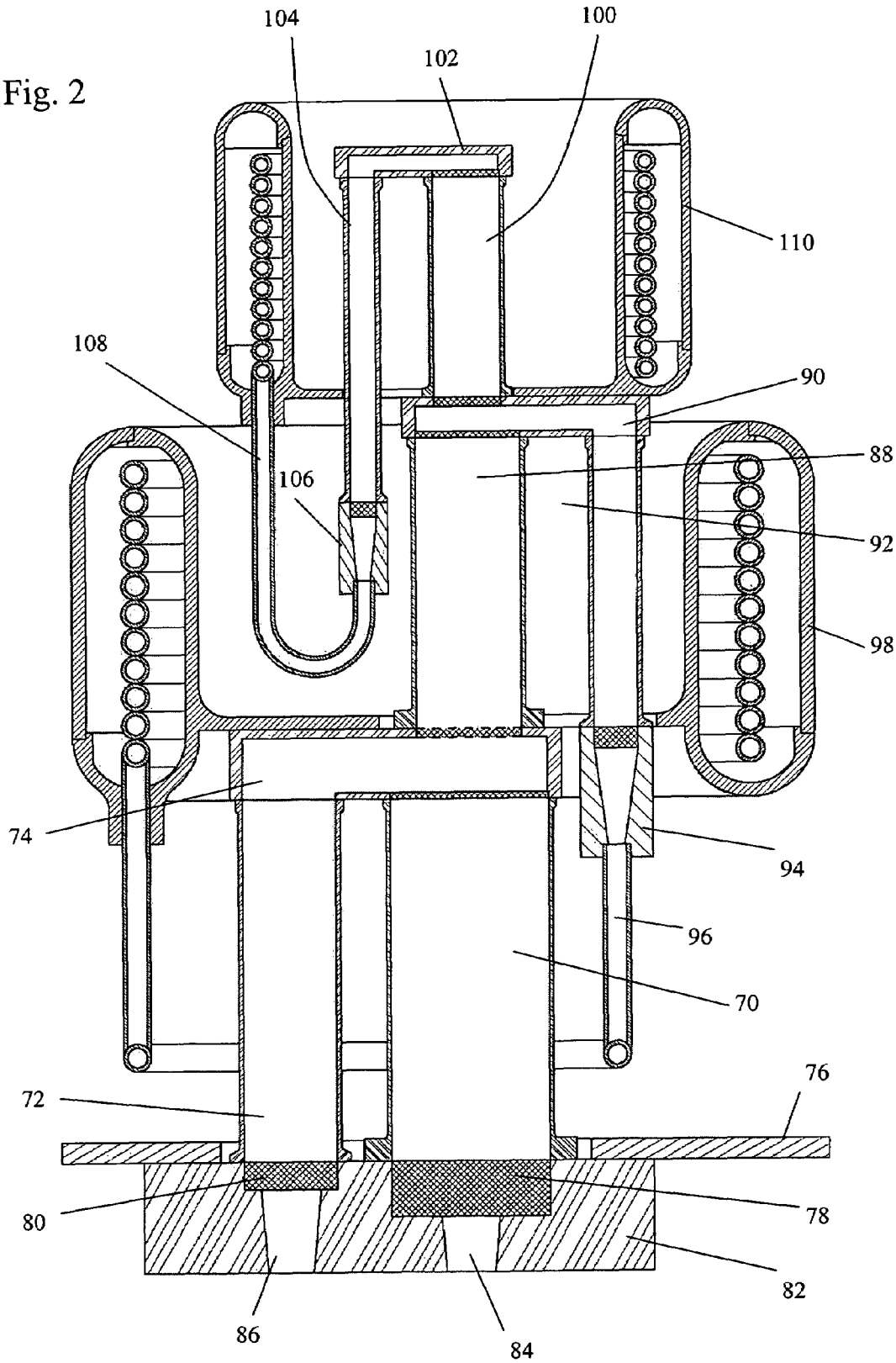
FIG. 2 is side elevation view partially in section illustrating a preferred embodiment of the invention.

FIG. 2 illustrates a more practical and preferred embodiment of the invention. The first stage cooler has a regenerator 70 connected to its pulse tube 72 through its turning manifold 74. These cold head components are mounted to the support plate 76 and its heat exchangers 78 and 80 are in thermally conductive connection to a manifold 82. Port 84 in the manifold 82 is conventionally connected to a pressure wave generator (not illustrated) and port 86 in manifold 82 is conventionally connected to an acoustic impedance (not illustrated) as in FIG. 1.

The second stage cooler has a regenerator 88 connected through a turning manifold 90 to its pulse tube 92 to form the second stage cold head. The pulse tube 92 is connected through an interiorly tapered manifold 94 to the second stage inertance tube 96 which leads into, is coiled within and opens into the second stage reservoir 98.

Similarly, the third stage cooler has a regenerator 100 connected through a turning manifold 102 to its pulse tube 104 to form the third stage cold head. The pulse tube 104 is connected through an interiorly tapered manifold 106 to the third stage inertance tube 108 which leads into, is coiled within and opens into the third stage reservoir 110.

Consequently, each stage higher than the first stage has at least a portion of its acoustic impedance spaced outwardly from and surrounding the cold head of the selected stage. In this configuration the outer surface of the reservoirs 98 and 110 are the exposed, radiating surfaces and therefore these reservoirs are advantageously constructed of a high diffusivity, low emissivity metal, preferably aluminum or an aluminum alloy.

Figure 3:
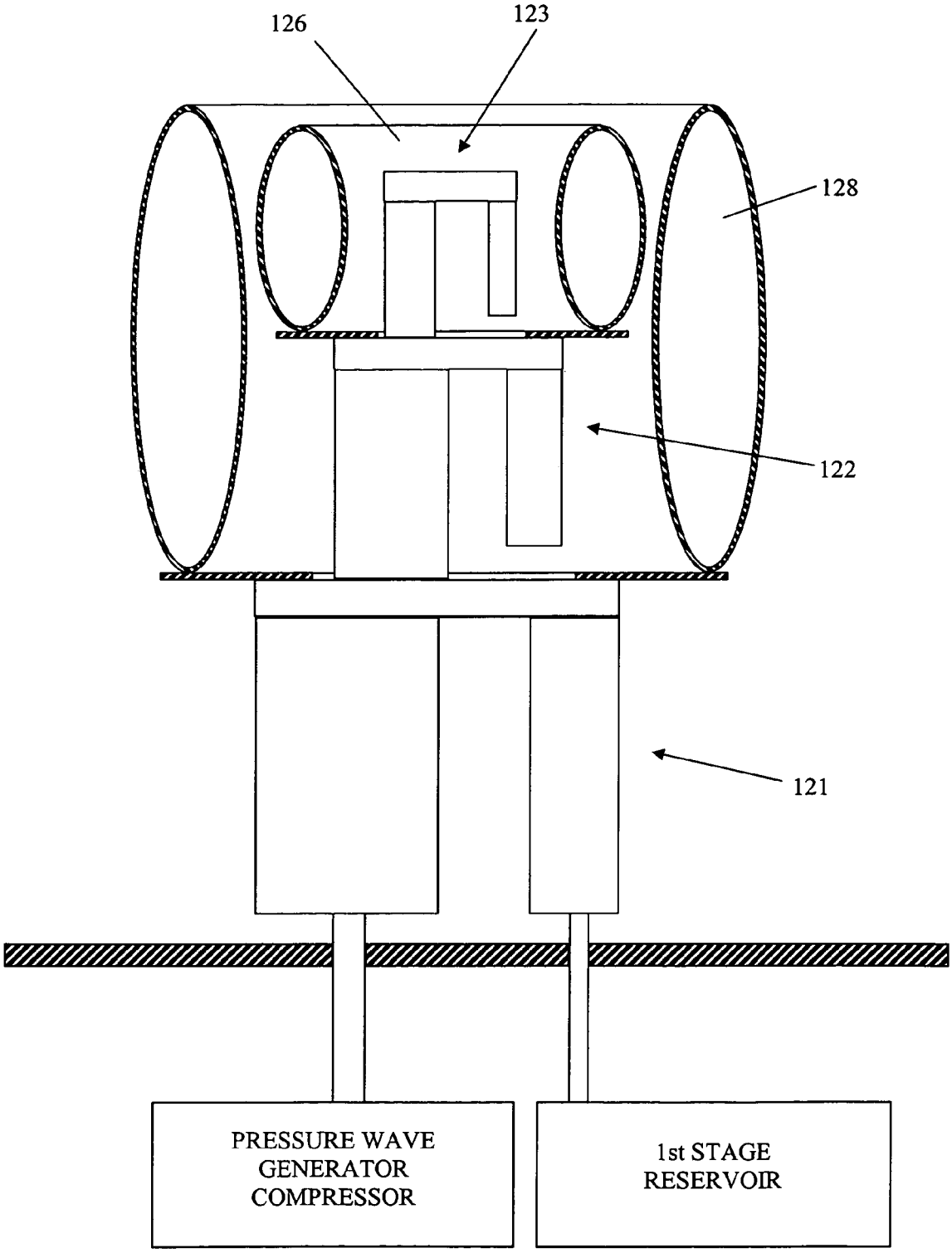
FIG. 3 is a simplified, schematic diagram similar to FIG. 1 and illustrating an alternative embodiment of the invention.

FIG. 3 illustrates an additional structural feature which may be applied to embodiments of the invention. Like the embodiment illustrated in FIG. 1, it has three pulse tube cooler stages with three staged cold heads 121, 122 and 123. Although the vacuum vessel and inertance tubes for each stage are not illustrated, they may be formed as in FIG. 1 or in a conventional manner. The third stage cold head 123 has a reservoir 126 portion of its acoustic impedance spaced outwardly from and surrounding the cold head 123 of the third stage as illustrated in FIG. 1. The second stage cold head 122 has a reservoir 128 portion of the acoustic impedance of the second stage cold head 122 spaced outwardly from and surrounding both the cold head 122 of the second stage and the surrounding reservoir 126 portion of the acoustic impedance of the third stage cold head 126. This is accomplished by extending the axial length of the reservoir 128 so it surrounds the third stage reservoir 126 and therefore the third stage cold head 123. Consequently, the advantages of the invention are doubly applied by having two acoustic impedance portions, in this case reservoirs 126 and 128, surrounding the lowest temperature cold head 123

While certain preferred embodiments of the present invention have been disclosed in detail, it is to be understood that various modifications may be adopted without departing from the spirit of the invention or scope of the following claims.

The invention claimed is:

1. An improved, pulse tube cryocooler having cascaded, multiple stages in which each stage includes a cold head comprising a regenerator connected to one end of a pulse tube and an acoustic impedance connected to the cold head at the opposite end of the pulse tube in order to properly phase the internal gas pressure and velocity, each cold head having a cold region for accepting heat and a warm region for rejecting heat, the cold heads being staged by thermally connecting the cold region of a lower stage to the warm region of a higher stage, wherein the improvement comprises:

at least a portion of the acoustic impedance of a selected stage, higher than the first stage, spaced outwardly from and surrounding the cold head of the selected stage;

wherein the acoustic impedance is formed of a metal having a thermal diffusivity of at least 20E-06 $m^2/s$;

wherein the acoustic impedance of the selected stage is mounted in thermally conductive connection to the warm region of the selected stage for cooling the acoustic impedance;

wherein the selected stage is a U-tube configuration;

wherein the acoustic impedance is annular; and wherein the acoustic impedance comprises an annular reservoir and an inertance tube wound around within the reservoir.

2. An improved, pulse tube cryocooler having cascaded, multiple stages in which each stage includes a cold head comprising a regenerator connected to one end of a pulse tube and an acoustic impedance connected to the cold head at the opposite end of the pulse tube in order to properly phase the internal gas pressure and velocity, each cold head having a cold region for accepting heat and a warm region for rejecting heat, the cold heads being staged by thermally connecting the cold region of a lower stage to the warm region of a higher stage, wherein the improvement comprises:

at least a portion of the acoustic impedance of a selected stage, higher than the first stage, spaced outwardly from and surrounding the cold head of the selected stage;

wherein the acoustic impedance is formed of a metal having a thermal diffusivity of at least 20E-06 $m^2/s$;

wherein the acoustic impedance of the selected stage is mounted in thermally conductive connection to the warm region of the selected stage for cooling the acoustic impedance;

wherein the selected stage is a U-tube configuration;

wherein the acoustic impedance is annular; and wherein a mounting plate is conductively and mechanically connected to the acoustic impedance and extends inwardly into thermally conductive and mechanical connection to warm region of the selected stage.

3. A cryocooler in accordance with claim 2 wherein said portion of the acoustic impedance is a coiled inertance tube component of the acoustic impedance.

4. A cryocooler in accordance with claim 2 wherein the acoustic impedance is formed of a metal having a radiation emissivity not greater than substantially 0.060.

5. A cryocooler in accordance with claim 4 wherein the acoustic impedance is formed of a metal having a thermal diffusivity of at least 50E-06 $m^2/s$.

6. An improved, pulse tube cryocooler having cascaded, multiple stages in which each stage includes a cold head comprising a regenerator connected to one end of a pulse tube and an acoustic impedance connected to the cold head at the opposite end of the pulse tube in order to properly phase the internal gas pressure and velocity, each cold head having a cold region for accepting heat and a warm region for rejecting heat, the cold heads being staged by thermally connecting the cold region of a lower stage to the warm region of a higher stage, wherein the improvement comprises:

at least a portion of the acoustic impedance of a selected stage, higher than the first stage, spaced outwardly from and surrounding the cold head of the selected stage; and wherein the cryocooler has at least three stages, the third stage having at least a portion of the acoustic impedance of the third stage spaced outwardly from and surrounding the cold head of the third stage and the second stage having at least a portion of the acoustic impedance of the second stage being spaced outwardly from and surrounding both the cold head of the second stage and the surrounding acoustic impedance of the third stage.

7. A cryocooler in accordance with claim 6 wherein the acoustic impedance is formed of a metal having a thermal diffusivity of at least 20E-06 $m^2/s$.

8. A cryocooler in accordance with claim 6 wherein the acoustic impedance of the selected stage is mounted in thermally conductive connection to the warm region of the selected stage for cooling the acoustic impedance.

9. A cryocooler in accordance with claim 6 wherein the selected stage is a U-tube configuration.

10. A cryocooler in accordance with claim 6 wherein the acoustic impedance is annular.

11. A cryocooler in accordance with claim 6 wherein the metal comprises aluminum.

12. A cryocooler in accordance with claim 6 wherein said portion of the acoustic impedance is a coiled inertance tube component of the acoustic impedance.

13. A cryocooler in accordance with claim 6 wherein the acoustic impedance is formed of a metal having a radiation emissivity not greater than substantially 0.060.

14. A cryocooler in accordance with claim 13 wherein the acoustic impedance is formed of a metal having a thermal diffusivity of at least 50E-06 $m^2/s$.

15. A cryocooler in accordance with claim 1 wherein the metal comprises aluminum.

16. A cryocooler in accordance with claim 2 wherein the metal comprises aluminum.

17. A cryocooler in accordance with claim 1 wherein said portion of the acoustic impedance is a coiled inertance tube component of the acoustic impedance.

18. A cryocooler in accordance with claim 1 wherein the acoustic impedance is formed of a metal having a radiation emissivity not greater than substantially 0.060.

19. A cryocooler in accordance with claim 18 wherein the acoustic impedance is formed of a metal having a thermal diffusivity of at least 50E-06 $m^2/s$.

* * * * *